US011846480B2

(12) United States Patent
Minneman et al.

(10) Patent No.: US 11,846,480 B2
(45) Date of Patent: Dec. 19, 2023

(54) BORE GUIDE FOR CLEANING A FIREARM

(71) Applicant: MTM Molded Products Company, Dayton, OH (US)

(72) Inventors: Steve William Minneman, Clayton, OH (US); Dexter Joseph Minneman, Huber Heights, OH (US)

(73) Assignee: MTM MOLDED PRODUCTS COMPANY, Dayton, OH (US)

( * ) Notice: Subject to any disclaimer, the term of this patent is extended or adjusted under 35 U.S.C. 154(b) by 341 days.

(21) Appl. No.: 17/231,792

(22) Filed: Apr. 15, 2021

(65) Prior Publication Data

US 2022/0034623 A1 Feb. 3, 2022

Related U.S. Application Data

(60) Provisional application No. 63/058,270, filed on Jul. 29, 2020.

(51) Int. Cl.

| | |
|---|---|
| ***F41A 29/00*** | (2006.01) |
| ***F41A 29/02*** | (2006.01) |
| ***B08B 9/04*** | (2006.01) |

(52) U.S. Cl.

CPC ..... *F41A 29/02* (2013.01); *B08B 9/04* (2013.01); *B08B 2209/04* (2013.01)

(58) Field of Classification Search

CPC ..... F41A 29/02; B08B 9/04

See application file for complete search history.

(56) References Cited

U.S. PATENT DOCUMENTS

| | | | | |
|---|---|---|---|---|
| 8,409,023 | B1 * | 4/2013 | Hogan | A63B 47/002 473/137 |
| 10,279,381 | B1 * | 5/2019 | Denison | A46B 5/0095 |
| 11,617,863 | B2 * | 4/2023 | DiCianni | A61M 25/065 604/159 |
| 2011/0277368 | A1 * | 11/2011 | Overstreet | F41A 29/02 42/108 |
| 2013/0283658 | A1 * | 10/2013 | Buie, II | F41A 29/02 42/95 |
| 2014/0158162 | A1 * | 6/2014 | Brooker | F41A 29/02 134/8 |
| 2019/0219354 | A1 * | 7/2019 | Sprinkel | F41A 29/02 |
| 2021/0207678 | A1 * | 7/2021 | Bielak, II | F16F 9/34 |

* cited by examiner

*Primary Examiner* — Michael D Jennings

(74) *Attorney, Agent, or Firm* — Bennet K. Langlotz; Langlotz Patent & Trademark Works, LLC

(57) ABSTRACT

A bore guide for cleaning a firearm has an elongated body defining a bore configured to receive a cleaning rod and brush, the elongated body having a forward end configured to be received in a chamber of the barrel and having a forward aperture to transmit the brush to the barrel bore, the elongated body having a rear end opposite the forward end and defining a rear aperture, a stop adjustably connected to an intermediate portion of the elongated body and movable over a range of different positions along the length of the elongated body, and the stop being adjustable to generate a rearward force against a portion of the firearm, and a forward force by the forward end of the elongated body against the chamber. The elongated body may be externally threaded, and the stop may engage the threads. The stop may extend laterally from the elongated body.

19 Claims, 4 Drawing Sheets

BORE GUIDE FOR CLEANING A FIREARM

CROSS-REFERENCE TO RELATED APPLICATION

This application claims the benefit of U.S. Provisional Patent Application No. 63/058,270 filed on Jul. 29, 2020, entitled "ADJUSTABLE BORE GUIDE FOR RIFLE BARREL CLEANING," which is hereby incorporated by reference in its entirety for all that is taught and disclosed therein.

FIELD OF THE INVENTION

The present invention relates to firearms, and more particularly to a bore guide for cleaning a firearm that aligns a cleaning rod down the barrel of rifle.

BACKGROUND AND SUMMARY OF THE INVENTION

Bore guides align a cleaning rod down the barrel of a rifle. Without a bore guide, the cleaning rod can scratch the chamber or bore of the rifle, causing accuracy issues. Bore guides also help to reduce the amount of cleaning solvent that gets into the action of the rifle. Prior art bore guides use a sliding collar on a metal tube as the main body. The sliding collar has a set screw to hold the sliding collar in place where desired along the metal tube. This method does not create a snug seal against the chamber of the gun, which results in some undesirable leakage of cleaning solvent into the action of the rifle and can unintentionally remove lubricants from the action.

Therefore, a need exists for a new and improved bore guide for cleaning a firearm that creates a snug seal in the chamber of the rifle to prevent leakage of cleaning solvent into the action of the rifle. In this regard, the various embodiments of the present invention substantially fulfill at least some of these needs. In this respect, the bore guide for cleaning a firearm according to the present invention substantially departs from the conventional concepts and designs of the prior art, and in doing so provides an apparatus primarily developed for the purpose of creating a snug seal in the chamber of the rifle to prevent leakage of cleaning solvent into the action of the rifle.

The present invention provides an improved bore guide for cleaning a firearm, and overcomes the above-mentioned disadvantages and drawbacks of the prior art. As such, the general purpose of the present invention, which will be described subsequently in greater detail, is to provide an improved bore guide for cleaning a firearm that has all the advantages of the prior art mentioned above.

To attain this, the preferred embodiment of the present invention essentially comprises an elongated body defining a bore configured to receive a cleaning rod and brush, the elongated body having a forward end configured to be received in a chamber of the barrel and having a forward aperture to transmit the brush to the barrel bore, the elongated body having a rear end opposite the forward end and defining a rear aperture, a stop adjustably connected to an intermediate portion of the elongated body and movable over a range of different positions along the length of the elongated body, and the stop being adjustable to generate a rearward force against a portion of the firearm, and a forward force by the forward end of the elongated body against the chamber. The elongated body may be externally threaded, and the stop may engage the threads. The stop may extend laterally from the elongated body. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1A:
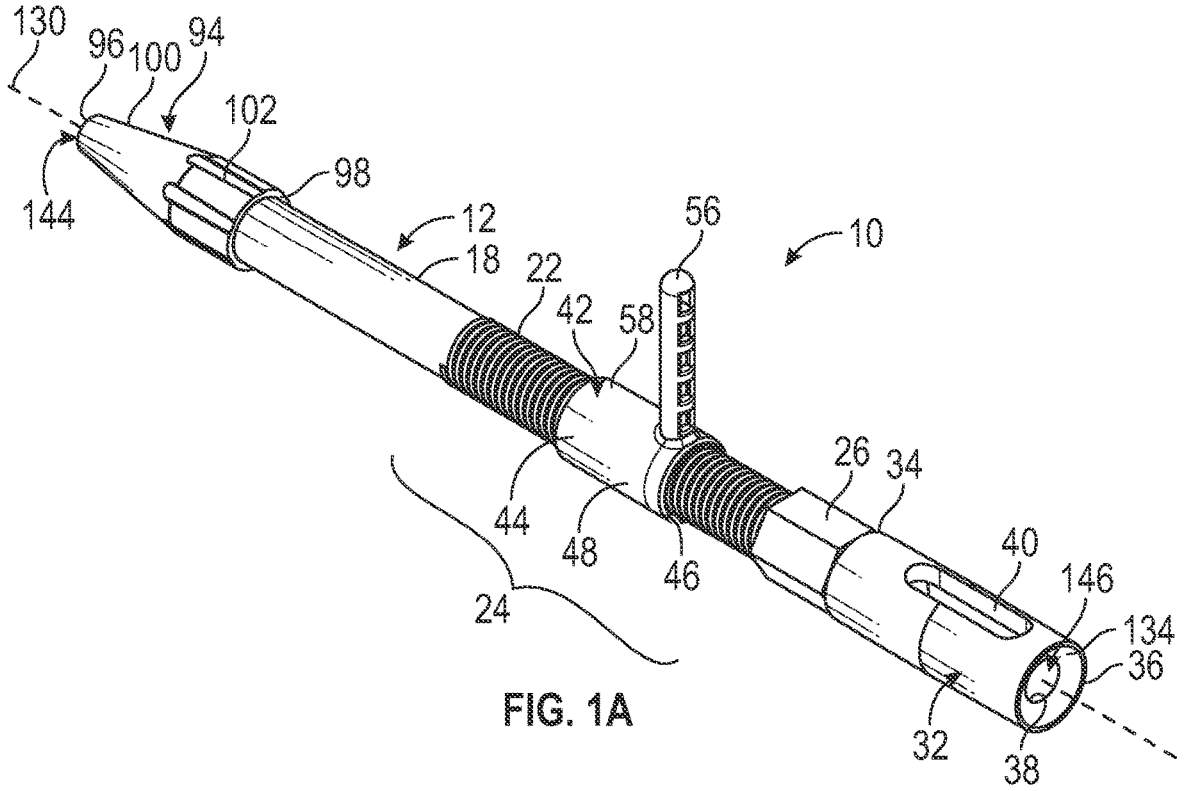
FIG. 1A is a top isometric view of the current embodiment of a bore guide for cleaning a firearm constructed in accordance with the principles of the present invention configured for use with a bolt action rifle.

An embodiment of the bore guide for cleaning a firearm of the present invention is shown and generally designated by the reference numeral 10.

Figure 1B:
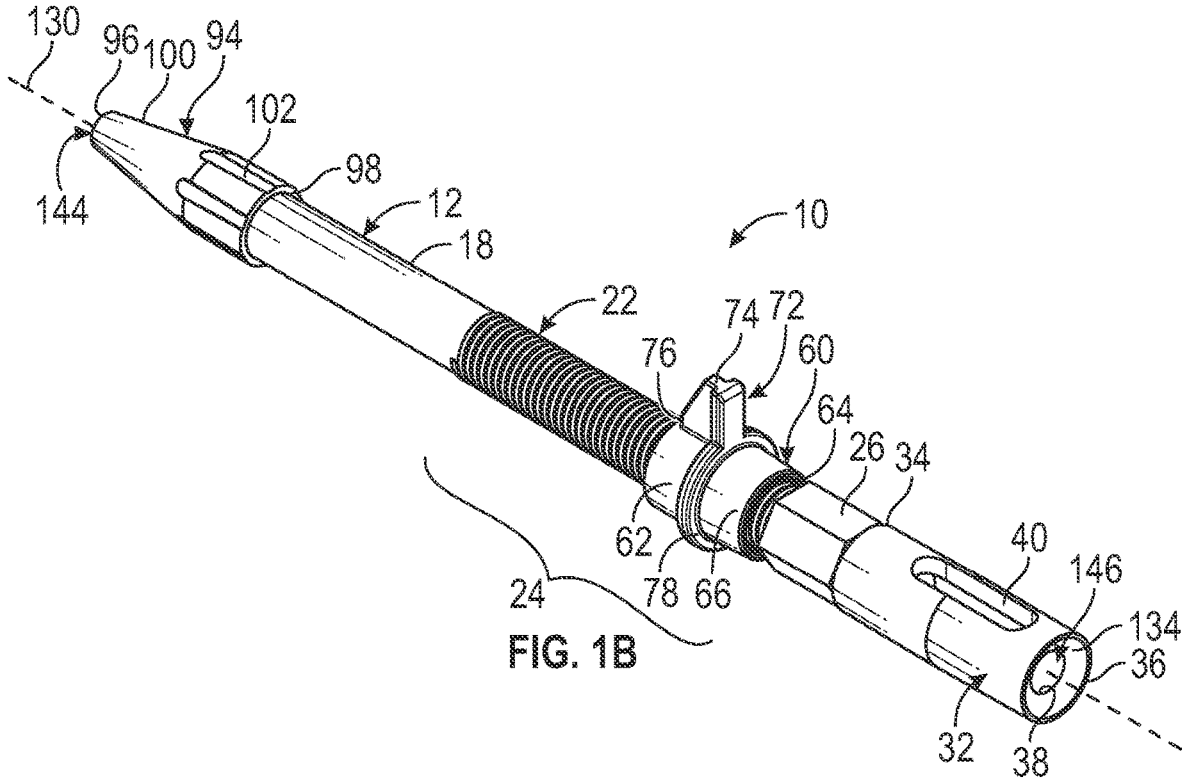
FIG. 1B is a top isometric view of the current embodiment of a bore guide for cleaning a firearm constructed in accordance with the principles of the present invention configured for use with an AR-15 rifle.
Figure 2:
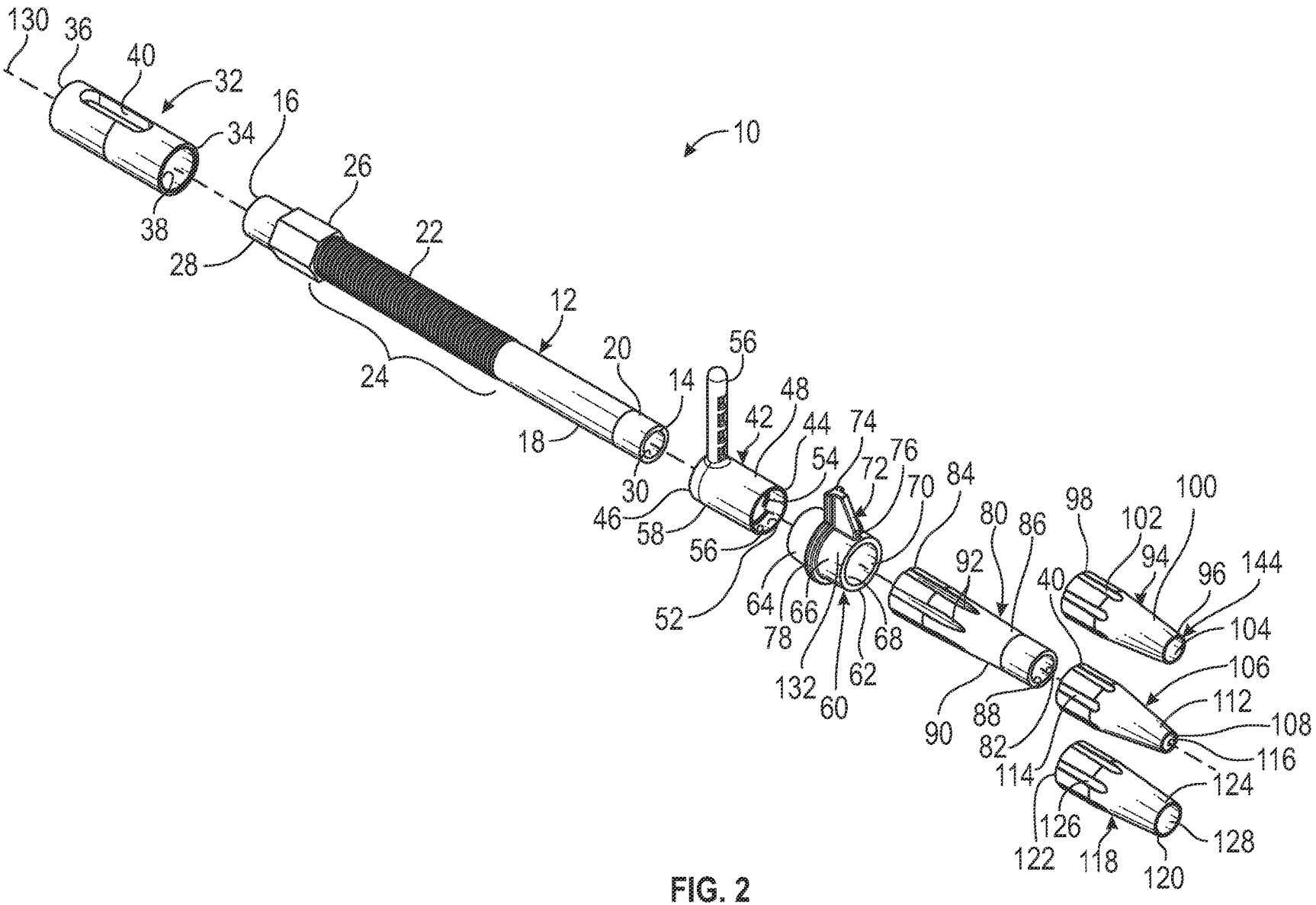
FIG. 2 is an exploded view of the bore guide for cleaning a firearm of FIGS. 1A & 1B in kit form showing all of the configurable components.

FIGS. 1A-2 illustrate the improved bore guide for cleaning a firearm 10 of the present invention. More particularly, FIG. 1A shows the bore guide for cleaning a firearm configured for use with a bolt action rifle, FIG. 1B shows the bore guide for cleaning a firearm configured for use with an AR-15 rifle, and FIG. 2 shows the bore guide for cleaning a firearm in kit form showing all of the configurable components.

Referring now to FIG. 2, the bore guide for cleaning a firearm 10 has an elongated body 12 having a front 14, rear 16, and external surface 18. The external surface includes a front portion 20, a threaded portion 22 rearward of the front portion forming an array of ridges 24, a nut portion 26 rearward of the threaded portion, and a rear portion 28 rearward of the nut portion. The elongated body also defines a bore 30 configured to receive a cleaning rod having an attached brush or cleaning patch (not shown). A patch insertion tip 32 having a front 34, rear 36 and defining a bore 38 and a cleaning solvent slot 40 is removably attached to the rear of the elongated body by inserting the rear portion of the elongated body into the front of the bore in the patch insertion tip to create a friction fit. The cleaning solvent slot facilitates the application of cleaning solvent to a brush or cleaning patch attached to a cleaning rod. The patch insertion tip guides the brush or cleaning patch into the elongated body as the cleaning rod is inserted into the rear of the bore of the patch insertion tip and subsequently into the rear of the bore in the elongated body. To facilitate insertion of the cleaning rod into the rear of the bore of the patch insertion tip, there is a tapered recess area 134 to guide the cleaning rod.

The bore guide for cleaning a firearm 10 in kit form includes a bolt action adapter 42 and an AR-15 adapter 60. Only one of the adapters is used at a time depending on the type of rifle to be cleaned. The bolt action adapter has a front 44, rear 46, external surface 48, internal surface 50, and defines a bore 52 that includes a single helical thread 54. A bolt action stop 56 extends laterally from the rear of the external surface. The external surface forward of the bolt action stop defines an end portion 58. The bolt action adapter is slid rearwardly over the front portion 20 of the elongated body 12 until the single helical thread reaches the threaded portion 22 of the elongated body, at which point the bolt action adapter and elongated body are helically engaged, and rotation of the elongated body causes the bolt action adapter to be movable over a range of different positions along the length of the elongated body.

Figure 5:
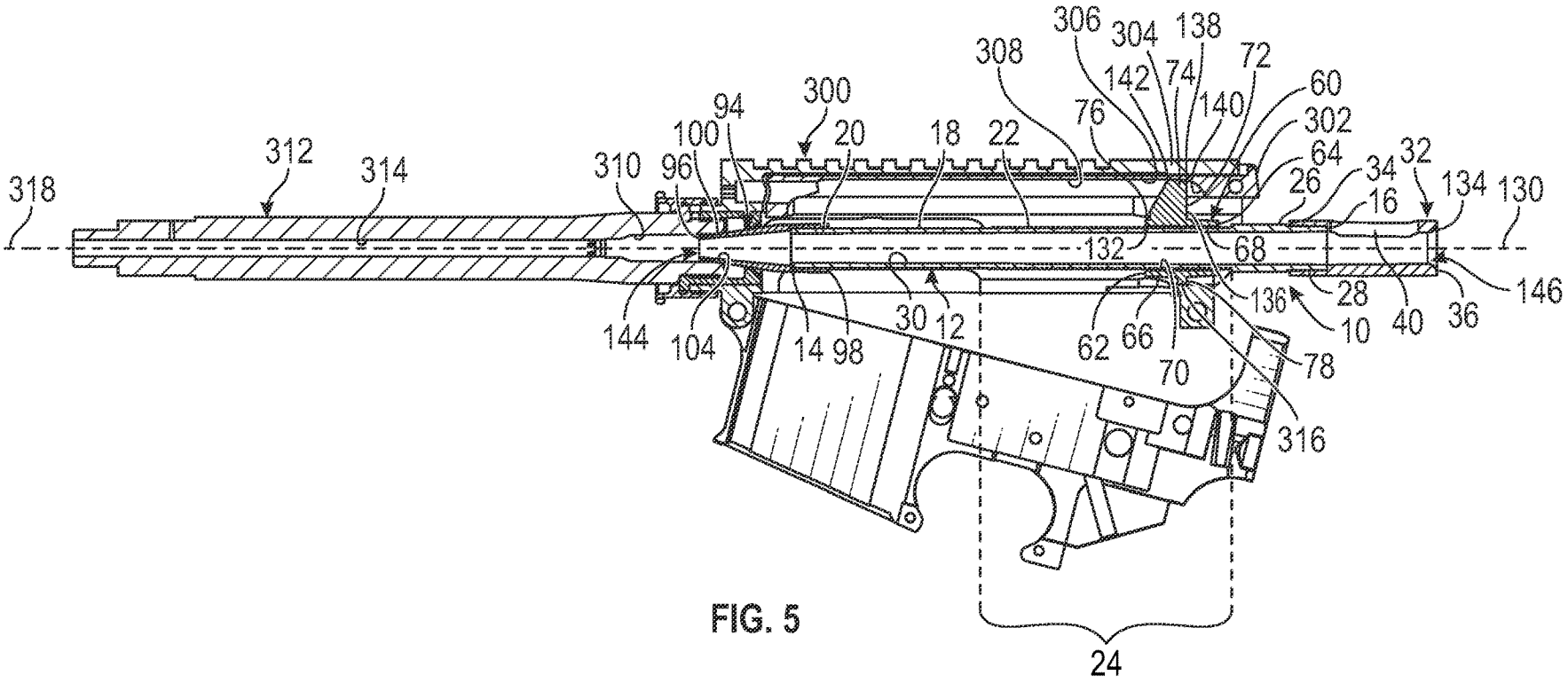
FIG. 5 is a side sectional view of the bore guide for cleaning a firearm of FIG. 1B in use with an AR-15 rifle.

The AR-15 adapter 60 has a front 62, rear 64, external surface 66, internal surface 68, and defines a bore 70 that includes a single helical thread (not visible). An AR-15 stop 72 extends laterally from the front of the external surface. The AR-15 stop includes an upper portion 74, a lower portion 76, and is triangular-shaped in the current embodiment. As is shown in FIG. 5, the upper portion has a rear surface 136 that has an upper corner 138 that compressible contacts a concave downward and forward-facing surface 140 on the underside of the charging handle as the upper surface of the rear of its down-facing channel 142. The AR-15 adapter also includes a flange 78 that encircles the external surface and extends up the rear portion of the AR-15 stop and an end portion 132 forward of the AR-15 stop. The AR-15 adapter is slid rearwardly over the front portion 20 of the elongated body 12 until the single helical thread reaches the threaded portion 22 of the elongated body, at which point the AR-15 adapter and elongated body are helically engaged, and rotation of the elongated body causes the AR-15 adapter to be movable over a range of different positions along the length of the elongated body.

The bore guide for cleaning a firearm 10 in kit form includes an extension tube 80, which is an optional component that enables the bore guide for cleaning a firearm to be used in rifles having longer actions. The extension tube has a front 82, rear 84, and an external surface 86. The extension tube defines a bore 88, and the external surface includes a front portion 90 and a plurality of flutes 92 at the rear. The extension tube is releasably attached to the front 14 of the elongated body 12 by inserting the front portion 20 of the elongated body into the rear of the bore in the extension tube to create a friction fit. The flutes facilitate removal of the extension tube from the elongated body.

The bore guide for cleaning a firearm 10 in kit form includes a first alignment tip 94, a second alignment tip 106, and a third alignment tip 118. Only one alignment tip is used at a time depending on the size of the chamber of the rifle to be cleaned. The alignment tips are identical except for having different tapers and diameters at their fronts 96, 108, 120 to create a snug fit with barrels having different chamber diameters to prevent cleaning solvent leakage into the action of the rifle and to align the cleaning rod with the chamber and barrel bore as the cleaning rod exits the selected alignment tip and enters the chamber and barrel bore. The first alignment tip has a front 96, rear 98, and an external surface 100 that defines a plurality of flutes 102 at the rear. The first alignment tip defines a bore 104 and is tapered to fit intermediate-sized chambers. The second alignment tip has a front 108, rear 110, and an external surface 112 the defines a plurality of flutes 114 at the rear. The second alignment tip defines a bore 116 and is tapered to fit small-sized chambers. The third alignment tip has a front 120, rear 122, and an external surface 124 that defines a plurality of flutes 126 of the rear. The third alignment tip defines a bore 128 and is tapered to fit large-sized chambers. The alignment tips are releasably attached to either the front 14 of the elongated body 12 or the front 82 of the extension tube 80 (if used) by inserting the front portion 20 of the elongated body or front portion 90 of the extension tube into the rear of the bore of the selected alignment tip to create a friction fit. The flutes facilitate removal of the selected alignment tip from the elongated body or extension tube. In the current embodiment, the second alignment tip fits small chamber calibers of .17-.24 (up to 6 mm), the first alignment tip fits medium chamber calibers of .25-.3 (6.5 to 7.62 mm), and the third alignment tip fits large chamber calibers greater than .3 (over 7.62 mm).

When the selected components are assembled into the desired configuration of the bore guide for cleaning a firearm 10, all of the bores of the selected components are axially registered along axis 130. In the current embodiment, all of the components of the bore guide for cleaning a firearm are made of plastic. The selected alignment tip provides the elongated body with a forward end configured to be received in a chamber of the barrel and a forward aperture 144 to transmit the brush or patch to the barrel bore. The patch insertion tip provides the elongated body with a rear end opposite the forward end and defining a rear aperture 146. The bolt action stop or AR-15 stop on the selected bolt action adapter or AR-15 adapter provides a stop adjustably connected to an intermediate portion of the elongated body via the selected adapter and movable over a range of different positions along the length of the elongated body. The threaded portion of the elongated body makes the elongated body externally threaded with external helical threads, and the single helical thread in both the bolt action adapter and the AR-15 adapter enables the stop to engage the threads via the selected adapter. The stop extends laterally from the elongated body via the selected adapter. The threads are an array of ridges defined by the elongated body, each providing a stable position for the selected adapter and therefore also the stop of the selected adapter. The stop via the selected adapter has an internal surface defining a thread configured to engage the elongated body. The elongated body and the stop are helically engaged via the selected adapter. The stop is operable to advance and retract along the length of the elongated body in response to rotation of the elongated body. The stop via the selected adapter defines a bore including a single internal thread extending at most only a single rotation within the bore. In the current embodiment, the bolt action adapter and AR-15 adapter can be formed by injection molding where the single helical thread is formed as a part line between two molds.

Figure 3:
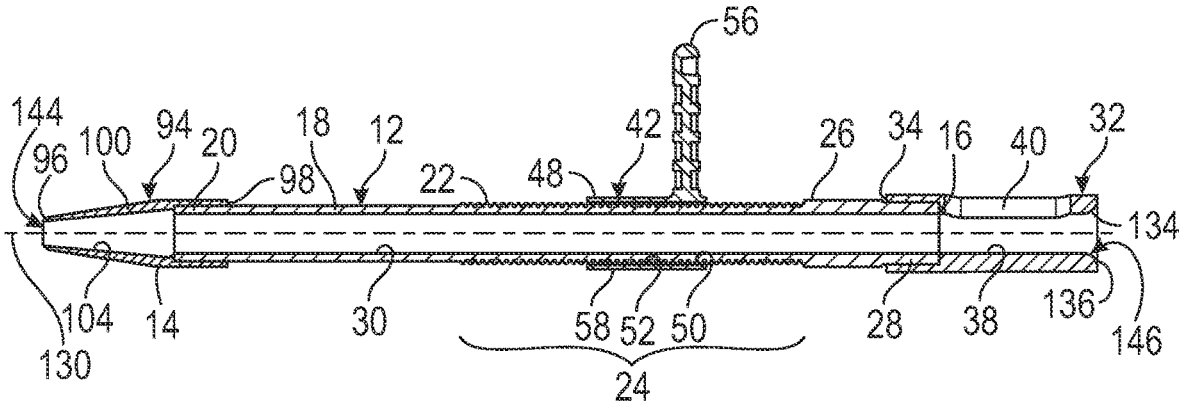
FIG. 3 is a side sectional view of the bore guide for cleaning a firearm of FIG. 1A configured for use with a bolt action rifle.
Figure 4:
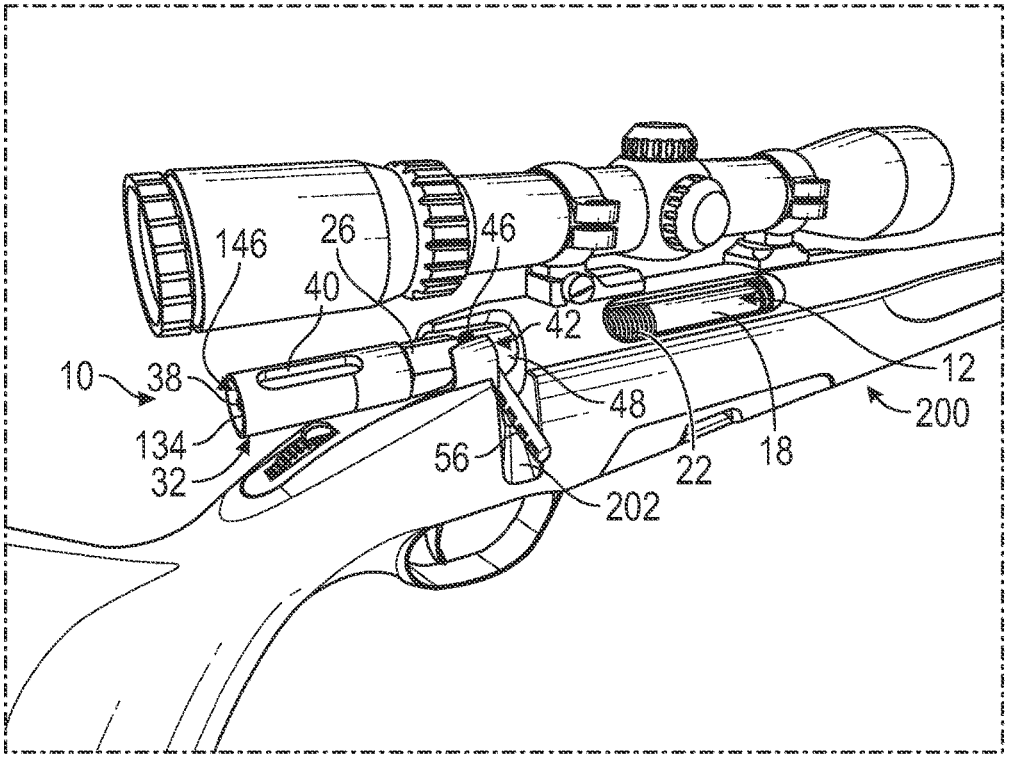
FIG. 4 is a rear isometric enlarged view of the bore guide for cleaning a firearm of FIG. 1A in use with a bolt action rifle.

In FIGS. 3 and 4, the bore guide for cleaning a firearm 10 is shown configured for use with a bolt action rifle 200. More particularly, FIG. 4 shows the bore guide for cleaning a firearm installed in a bolt action rifle. To clean a bolt action rifle, the user configures the bore guide for cleaning a firearm by selecting and attaching the bolt action adapter 42 and a suitable alignment tip based on the caliber of the bolt action rifle (first alignment tip 94 is illustrated) to the elongated body 12. The user then removes the magazine and bolt from the bolt action rifle and inserts the selected alignment tip and the elongated body into the bolt action rifle until the bolt action stop 56 is aligned with the bolt handle slot 202 of the bolt action rifle. The user then turns the bolt action stop into the bolt handle slot so the bolt action stop is secured against longitudinal movement. The user then grasps the nut portion 26 of the elongated tube and rotates the elongated body until slight friction as felt as the front of the selected alignment tip contacts the rear of the chamber of the barrel. The user then rotates the elongated body an additional 90° to create a snug fit between the front of the selected alignment tip and the chamber to prevent cleaning solvent leakage. The user then attaches the patch insertion tip 32 to the rear portion 28 of the elongated body. Finally, the user inserts a cleaning rod having an attached brush or cleaning patch into the bore guide for cleaning a firearm through the rear of the patch insertion tip, optionally applies solvent to the brush or cleaning patch through the cleaning solvent slot 40, and inserts the cleaning rod all the way through the bore guide for cleaning a firearm and down the length of the chamber and barrel bore. The installation procedure is reversed to remove the bore guide for cleaning a firearm from the bolt action rifle and to restore the bolt action rifle to the operable condition.

In FIG. 5, the bore guide for cleaning a firearm 10 is shown configured for use with an AR-15 rifle 300. More particularly, FIG. 5 shows the bore guide for cleaning a firearm installed in an AR-15 rifle. To clean an AR-15 rifle, the user configures the bore guide for cleaning a firearm by selecting and attaching the AR-15 adapter 60, the extension tube 80 if the AR-15 has a longer action, and a suitable alignment tip based on the caliber of the AR-15 rifle (first alignment tip 94 is illustrated) to the elongated body 12. The user then unlocks the charging handle 302 and removes the bolt carrier group from the AR-15 rifle. The user then inserts the selected alignment tip and the elongated body into the upper receiver 304 with the AR-15 stop 72 in a vertical position with the upper portion 74 engaged with an elongated channel 306 defined by the bottom 308 of the charging handle. The AR-15 adapter is securely held in place against longitudinal movement by closing the charging handle. The user then grasps the nut portion 26 of the elongated tube and rotates the elongated body until slight friction as felt as the front of the selected alignment tip contacts the rear of the chamber 310 of the barrel 312. The user then rotates the elongated body an additional 90° to create a snug fit between the front of the selected alignment tip and the chamber to prevent cleaning solvent leakage. The user then attaches the patch insertion tip 32 to the rear portion 28 of the elongated body. Finally, the user inserts a cleaning rod having an attached brush or cleaning patch into the bore guide for cleaning a firearm through the rear of the patch insertion tip, optionally applies solvent to the brush or cleaning patch through the cleaning solvent slot 40, and inserts the cleaning rod all the way through the bore guide for cleaning a firearm and down the length of the chamber and barrel bore 314. The installation procedure is reversed to remove the bore guide for cleaning a firearm from the AR-15 rifle and to restore the AR-15 rifle to the operable condition. It should be appreciated that once the bore guide for cleaning a firearm is securely installed within the AR-15 rifle, the axis 130 of the bore guide for cleaning a firearm is axially registered with the barrel axis 318 of the AR-15 rifle.

It can be appreciated from the above description that the stop of the selected adapter is adjustable to generate a rearward force against a portion of the firearm (the rear of the bolt handle slot of the bolt action rifle or the rear of the elongated channel defined by the bottom of the charging handle of the AR-15 rifle). The stop of the selected adapter is responsive to rotation of the elongated body to sustain the rearward force. The stop of the selected adapter is also adjustable to generate a forward force by the forward end of the elongated body against the chamber via the selected alignment tip. The stop of the selected adapter is also configured to extend through an exit port of the firearm (the rear opening of the passage that receives the bolt in the case of a bolt action rifle or the bolt carrier group in the case of an AR-15 rifle). The stop of the selected adapter has a limited length and an end portion configured to be entirely received in the firearm. The AR-15 stop of the AR-15 adapter is configured to engage an internal feature in an upper wall portion of the firearm (the engagement of the AR-15 stop with the elongated channel in the bottom of the charging handle). The AR-15 stop of the AR-15 adapter has an upper portion configured to engage a ledge associated with a receiver (the engagement of the upper portion of the AR-15 stop with the elongated channel in the bottom of the charging handle attached to the upper receiver), and a lower portion configured to engage a lower surface of the receiver opposed to the ledge (the bottom edge of the flange 78 of the AR-15 adapter contacts lower surface 316 of the upper receiver). The bolt action stop is an elongated protrusion configured to engage a bolt handle slot on the bolt action rifle.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a bore guide for cleaning a firearm has been described in detail, it should be apparent that modifications and variations thereto are possible, all of which fall within the true spirit and scope of the invention. Although rifles have been disclosed, the bore guide for cleaning a firearm is also suitable for use with shotguns, light and medium machine guns, and other firearms. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A bore guide for cleaning a firearm having a barrel comprising:

an elongated body defining a bore configured to receive a cleaning rod and brush;

the elongated body having a forward end configured to be received in a chamber of the barrel and having a forward aperture to transmit the brush to the barrel bore;

the elongated body having a rear end opposite the forward end and defining a rear aperture;

a stop adjustably connected to an intermediate portion of the elongated body and movable over a range of different positions along the length of the elongated body;

the stop being adjustable to generate a rearward force against a portion of the firearm, a forward force by the forward end of the elongated body against the chamber; and wherein the elongated body is externally threaded, and the stop engages the threads.

2. The bore guide for cleaning a firearm of claim 1 wherein the stop extends laterally from the elongated body.

3. The bore guide for cleaning a firearm of claim 1 wherein the stop is configured to extend through an exit port of the firearm.

4. The bore guide for cleaning a firearm of claim 1 wherein the stop is responsive to rotation of the elongated body to sustain the rearward force.

5. The bore guide for cleaning a firearm of claim 1 wherein the stop has a limited length and an end portion configured to be entirely received in the firearm.

6. The bore guide for cleaning a firearm of claim 5 wherein the stop is configured to engage an internal feature in an upper wall portion of the firearm.

7. The bore guide for cleaning a firearm of claim 1 wherein the stop is an elongated protrusion configured to engage a bolt handle slot on the firearm.

8. A bore guide for cleaning a firearm having a barrel comprising:

an elongated body defining a bore configured to receive a cleaning rod and brush;

the elongated body having a forward end configured to be received in a chamber of the barrel and having a forward aperture to transmit the brush to the barrel bore;

the elongated body having a rear end opposite the forward end and defining a rear aperture;

a stop adjustably connected to an intermediate portion of the elongated body and movable over a range of different positions along the length of the elongated body;

the stop being adjustable to generate a rearward force against a portion of the firearm, and a forward force by the forward end of the elongated body against the chamber; and wherein the stop has an upper portion configured to engage a ledge associated with a receiver, and a lower portion configured to engage a lower surface of the receiver opposed to the ledge.

9. A bore guide for cleaning a firearm having a barrel comprising:

an elongated body defining a bore configured to receive a cleaning rod and brush;

the elongated body having a forward end configured to be received in a chamber of the barrel and having a forward aperture to transmit the brush to the barrel bore;

the elongated body having a rear end opposite the forward end and defining a rear aperture;

a stop adjustably connected to an intermediate portion of the elongated body and movable over a range of different positions along the length of the elongated body;

the stop being adjustable to generate a rearward force against a portion of the firearm, and a forward force by the forward end of the elongated body against the chamber; and wherein the elongated body defines an array of ridges each providing a stable position of the stop.

10. A bore guide for cleaning a firearm having a barrel comprising:

an elongated body defining a bore configured to receive a cleaning rod and brush;

the elongated body having a forward end configured to be received in a chamber of the barrel and having a forward aperture to transmit the brush to the barrel bore;

the elongated body having a rear end opposite the forward end and defining a rear aperture;

a stop adjustably connected to an intermediate portion of the elongated body and movable over a range of different positions along the length of the elongated body;

the stop being adjustable to generate a rearward force against a portion of the firearm, and a forward force by the forward end of the elongated body against the chamber; and wherein the stop has an internal surface defining a thread configured to engage the elongated body.

11. A bore guide for cleaning a firearm having a barrel comprising:

an elongated body defining a bore configured to receive a cleaning rod and brush;

the elongated body having a forward end configured to be received in a chamber of the barrel and having a forward aperture to transmit the brush to the barrel bore;

the elongated body having a rear end opposite the forward end and defining a rear aperture;

a stop adjustably connected to an intermediate portion of the elongated body and movable over a range of different positions along the length of the elongated body;

the stop being adjustable to generate a rearward force against a portion of the firearm, and a forward force by the forward end of the elongated body against the chamber; and wherein the elongated body and stop are helically engaged.

12. A bore guide for cleaning a firearm having a barrel comprising:

an elongated body defining a bore configured to receive a cleaning rod and brush;

the elongated body having a forward end configured to be received in a chamber of the barrel and having a forward aperture to transmit the brush to the barrel bore;

the elongated body having a rear end opposite the forward end and defining a rear aperture;

a stop adjustably connected to an intermediate portion of the elongated body and movable over a range of different positions along the length of the elongated body;

the stop being adjustable to generate a rearward force against a portion of the firearm, and a forward force by the forward end of the elongated body against the chamber; and wherein the stop is operable to advance and retract along the length of the elongated body in response to rotation of the elongated body.

13. A bore guide for cleaning a firearm having a barrel comprising:

an elongated body defining a bore configured to receive a cleaning rod and brush;

the elongated body having a forward end configured to be received in a chamber of the barrel and having a forward aperture to transmit the brush to the barrel bore;

the elongated body having a rear end opposite the forward end and defining a rear aperture;

a stop adjustably connected to an intermediate portion of the elongated body and movable over a range of different positions along the length of the elongated body;

the stop being adjustable to generate a rearward force against a portion of the firearm, and a forward force by the forward end of the elongated body against the chamber; and wherein the stop defines a bore including a single internal thread extending at most only a single rotation within the bore.

14. A bore guide for cleaning a firearm having a barrel comprising:

an elongated body defining a bore configured to receive a cleaning rod and brush;

the elongated body having a forward end configured to be received in a chamber of the barrel and having a forward aperture to transmit the brush to the barrel bore;

the elongated body having a rear end opposite the forward end and defining a rear aperture;

the elongated body having external helical threads;

a stop having a lateral protrusion, threadably engaged to the threads of the elongated body.

15. The bore guide for cleaning a firearm of claim 14 wherein the stop extends laterally from the elongated body.

16. The bore guide for cleaning a firearm of claim 14 wherein the stop has a limited length and an end portion configured to be entirely received in the firearm.

17. The bore guide for cleaning a firearm of claim 14 wherein the stop has an upper portion configured to engage a ledge associated with a receiver, and a lower portion configured to engage a lower surface of the receiver opposed to the ledge.

18. The bore guide for cleaning a firearm of claim 14 wherein the stop is an elongated protrusion configured to engage a bolt handle slot on the firearm.

19. The bore guide for cleaning a firearm of claim 14 wherein the stop defines a bore including a single internal thread extending at most only a single rotation within the bore.

* * * * *